US005119754A

United States Patent [19]

Martinez et al.

[11] Patent Number: 5,119,754

[45] Date of Patent: Jun. 9, 1992

[54] BOAT SEAT STABILIZING APPARATUS

[76] Inventors: Henry A. Martinez; Joseph N. Martinez, both of P.O. Box 232, Geismar, La. 70734

[21] Appl. No.: 703,165

[22] Filed: May 20, 1991

[51] Int. Cl.[5] ..... B63B 29/12

[52] U.S. Cl. ..... 114/363; 114/194

[58] Field of Search ..... 114/191-195, 114/363; 297/313-316, 326-328, 344

[56] References Cited

U.S. PATENT DOCUMENTS

| | | | |
|---|---|---|---|
| 179,443 | 7/1876 | Blair | 114/194 |
| 968,195 | 8/1910 | Reed | 114/194 |
| 1,689,964 | 10/1928 | Perego | 114/194 |
| 2,740,599 | 4/1956 | Roberts-Horsfield | 114/194 |
| 3,428,976 | 2/1969 | Robinson | 114/363 |
| 4,254,990 | 3/1981 | Kelley | 114/194 |
| 4,425,863 | 1/1984 | Cutler | 114/194 |

*Primary Examiner*—Edwin L. Swinehart

*Attorney, Agent, or Firm*—William David Kiesel; Robert C. Tucker

[57] ABSTRACT

A boat seat stabilizing apparatus is provided which includes a support column having a base fixedly attachable to the deck of a boat for supporting other connected parts of the device; a first support arm having a front portion pivotally attached to the support column in a manner to remain about horizontal; a second support arm having an upper portion pivotally attached to the first support arm in a manner to remain about vertical, and further including a chair mounting post to which a boat seat chosen by the operator is attachable; a pitch guard mechanism operatively connected to the first support arm and the support column to substantially prevent foreign objects from entering the area of attachment between the first support arm and the support column; and a roll guard mechanism operatively connected to the second support arm and the first support arm to substantially prevent foreign objects from entering the area of attachment between the second support arm and the first support arm. A position locking device is also provided which allows the operator to lock the apparatus in a fixed position so that the invention may also be used as any other non-stabilized boat seat should sea conditions warrant.

14 Claims, 5 Drawing Sheets

BOAT SEAT STABILIZING APPARATUS

BACKGROUND OF THE INVENTION

I. Field of the Invention

The present invention relates generally to devices for stabilizing a seat in a vehicle which may be subject to both pitch and roll motions, as well as to devices used to eliminate or reduce the risk of fatigue and motion sickness.

II. Description of Prior Art

For persons who spend any time in boats, major drawbacks can be the inevitable feeling of fatigue and the ever present possibility of motion sickness due to the unceasing roll and pitch of the watercraft on the waves. Devices which either eliminate or reduce the risk of these effects are a welcome addition to the marine equipment available on such crafts, whether for recreational or commercial purposes. A variety of such devices have been developed to achieve this result consisting largely of strategically placed gimbals, yokes and pendulums which operate to maintain a seat in a constant level position with respect to the horizon. Though each of these inventions operates differently, they all have in common the requirement that the center of gravity of the seat and the person occupying it be below the pivot points in order to maintain stability.

One such device is disclosed in Blair, U.S. Pat. No. 179,443. That invention consists of a rigid beam supporting a horizontal pivot which allows for roll motion of a yoke pivotally attached to a chair. Because the chair is allowed to pivot inside the yoke, stabilization for pitch motion is also provided. However, a disadvantage of this chair is that a ballast is needed beneath the seat to bring the center of gravity safely below the pivot points.

Another stabilized seat is disclosed in Perego, U.S. Pat. No. 1,689,964, wherein a deck chair is supported by a single rod pivotally attached to a ball and socket joint and allowing for motion in roll and pitch by swinging in pendulum fashion. Movement is damped in both directions by the presence of springs attached to distal points on the deck chair. Although an advantage of this apparatus may be its collapsibility when not in use, the frame required to support the deck chair is bulky and is not suitable for use by a person piloting the craft.

A chair similar to Blair is taught in Kelley, U.S. Pat. No. 4,254,990, wherein stabilization for roll is provided by an inverted V-shaped member supported by a spring-biased pivot at the top of a column behind the chair. Each end of the inverted V-shaped member attaches under the arms of the chair and provides stability for pitch motion at those points through the use of two additional spring-biased pivots.

The device in Cutler, U.S. Pat. No. 4,425,863, provides stabilization for roll motions of the host craft by the use of a single pivot attached directly to an adjustable support column. No stabilization for pitch motion is provided for in the Cutler device, and the operator is relegated to either using the seat chosen by the manufacturer or substantially modifying a conventional boat seat.

In summary, none of these devices readily allow for use of a seat chosen by the operator. In addition, none of the prior art patents contain safety features designed to prevent objects from becoming accidentally caught in the pivoting mechanisms, while maintaining the versatility to position the seat in different directions. Furthermore, none of these devices allow for fixing the apparatus in a locked position so that the seat may also be used as any other non-stabilized boat seat should sea conditions or other reasons of utility warrant.

SUMMARY OF THE INVENTION

It is therefore an object of this invention to provide a boat seat stabilizing apparatus that reduces the effect of fatigue and motion sickness by stabilizing a seat for both pitch and roll motions of the supporting craft.

It is also an object of this invention to provide a boat seat stabilizing apparatus that is simple to use and maintain.

It is a further object of this invention to provide a boat seat stabilizing apparatus that has safety features which significantly reduce the hazards of foreign objects becoming caught in the hinging portions of the device.

It is also an object of this invention to provide a boat seat stabilizing apparatus that is capable of being manipulated to face in an opposite direction.

It is yet another object of this invention to provide a boat seat stabilizing apparatus that allows a user to mount a seat of his own choosing by way of a standard column boat seat mount.

It is also an object of this invention to provide a boat seat stabilizing apparatus that includes a position locking feature which allows the operator to secure the apparatus in a fixed position and use the invention as a non-stabilized boat seat.

These and other objects and advantages of the present invention will no doubt become apparent to those skilled in the art after having read the following description of the preferred embodiment which are contained in and illustrated by the various drawing figures.

Therefore, in a preferred embodiment, a boat seat stabilizing apparatus is provided which includes a support column having a base fixedly attachable to a boat for supporting other connected parts of the device; a first support arm having a front portion pivotally attached to the support column in a manner to remain about horizontal; a second support arm having an upper portion pivotally attached to the first support arm in a manner to remain about vertical, and further including a chair mounting means to which a boat seat chosen by the operator is attachable; a pitch guard means operatively connected to the first support arm and the support column to substantially prevent foreign objects from entering the area of attachment between the first support arm and the support column; and a roll guard means operatively connected to the second support arm and the first support arm to substantially prevent foreign objects from entering the area of attachment between the second support arm and the first support arm. A position locking means is also provided which allows the operator to lock the apparatus in a fixed position so that the invention may also be used as any other non-stabilized boat seat should sea conditions warrant.

DETAILED DESCRIPTION OF THE PREFERRED EMBODIMENT

Figure 1:
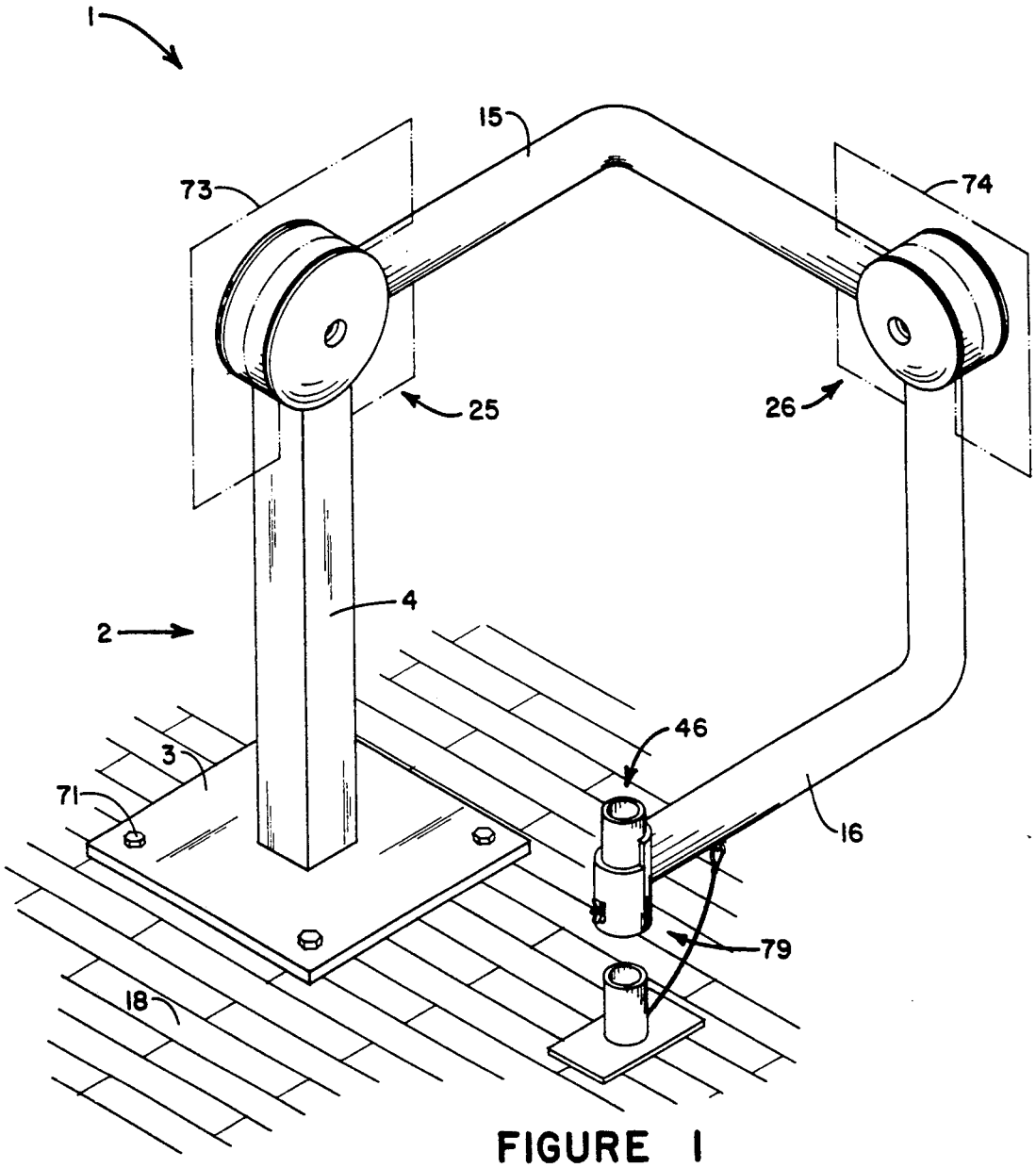
FIG. 1 is an isometric view of a preferred embodiment of the apparatus according to the invention.

Referring more particularly to the drawings, an isometric view of a preferred embodiment of the boat seat stabilizing apparatus 1 is shown in FIG. 1, and includes a support means 2, a first support arm 15 pivotally connected to support means 2 in a manner to allow rotation in a first vertical plane 73, and a second support arm 16 pivotally connected to first support arm 15 in a manner to allow rotation in a second vertical plane 74 which is perpendicular to first vertical plane 73. Pitch guard means 25 and roll guard means 26 serve to prevent foreign objects from entering the pivoting areas between support means 2 and first support arm 15, and between first support arm 15 and second support arm 16, respectively.

Figure 2A:
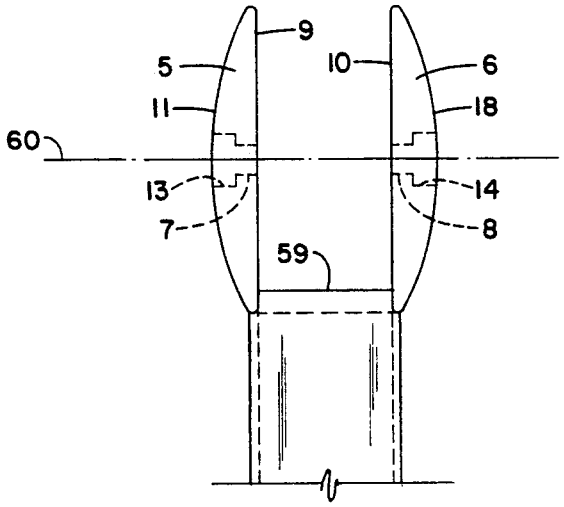
FIG. 2 is a front and side view of the support column showing a portion of the pitch guard means of the invention.
Figure 2A:
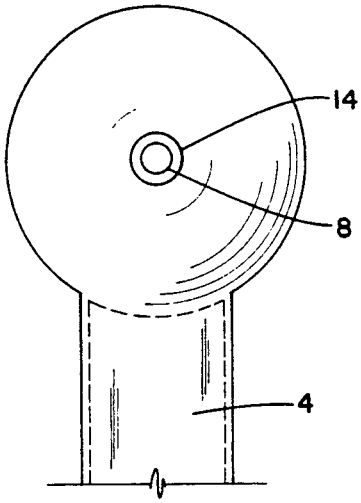
Figure 2:
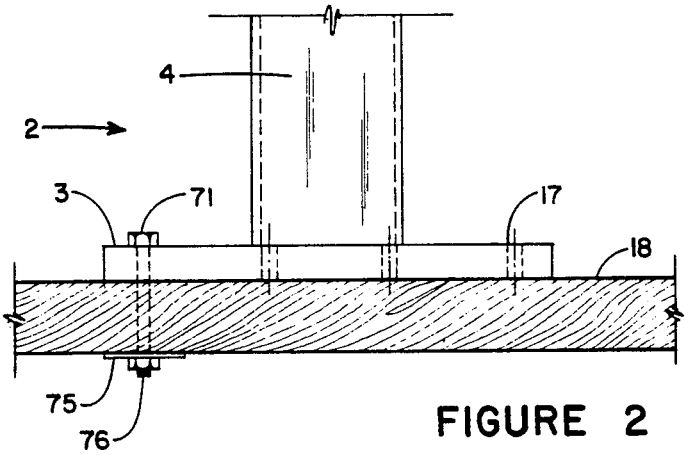

In FIG. 2, a preferred embodiment of support means 2 may contain a base 3, a vertical support column 4 welded to base 3, and first and second pitch plates 5, 6 of pitch guard means 25. Base 3 contains bolt holes 17 formed perpendicular to base 3 to allow for the use of mounting bolts 71, mounting washers 75 and mounting nuts 76 in a number and placement sufficient to securely fix apparatus 1 to deck 18 during operation. Both first and second pitch plates 5, 6 have first and second pitch holes 7, 8 formed through their respective centers perpendicular to their respective inner walls 9, 10, and are attached to support column 4 by either welding or cast as a part of support column 4 so that the centers of holes 7, 8 are aligned to form a pitch axis 60 perpendicular to inner walls 9, 10. Outer walls 11, 12 of pitch plates 5, 6 are each shaped to form an outwardly convex surface. Recesses 13, 14 are formed concentric with holes 7, 8 into outer walls 11, 12 to a depth sufficient to accommodate fastening hardware to avoid hardware contact with persons aboard the craft.

Figure 3:
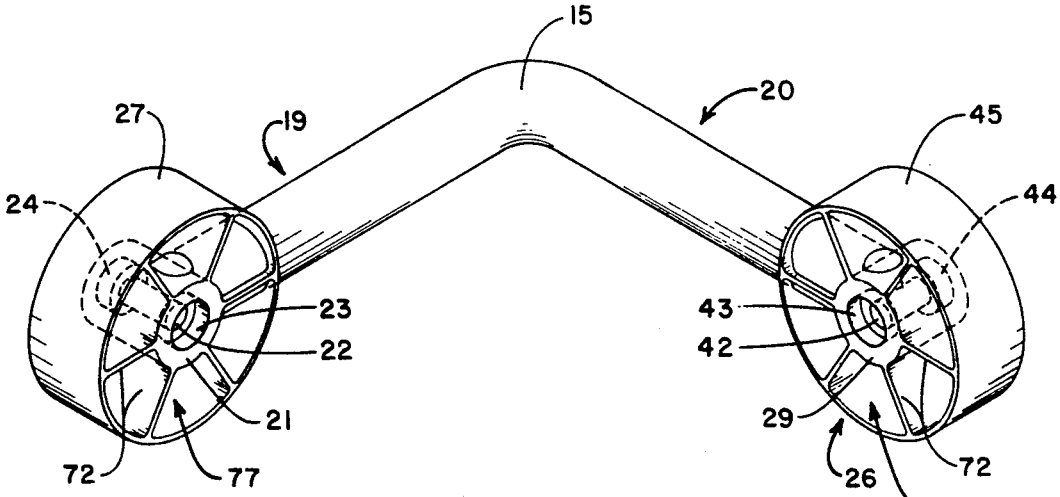
FIG. 3 is an isometric view of the first support arm showing portions of both the pitch guard means and the roll guard means.

First support arm 15, shown in FIGS. 1 and 3, is a casted beam consisting of a front portion 19 in pivotal communication between support column side plates 5, 6, and a back portion 20 angled 90 degrees in a horizontal plane relative to front portion 19. Cylinders 21, 29 are perpendicularly and fixedly attached to front portion 19 and back portion 20, respectively by either welding or cast as a part of first support arm 15. Each of these cylinders 21, 29 includes shaft holes 22, 42, respectively, extending along the longitudinal axis of cylinders 21, 29 and have counterbores 23, 24, and 43, 44, respectively, formed on each end of cylinders 21, 29 concentric with shaft holes 22, 42, respectively. Also shown in FIG. 3 is an embodiment of the inner assemblies 77, 78 of pitch guard means 25 and roll guard means 26, respectively. Inner assemblies 77, 78 include guard covers 27, 45, respectively, which are attached to front portion 19 and back portion 20, respectively, by either welding or cast as a part of first support arm 15 such that guard covers 27, 45 are concentric with cylinders 21, 29, respectively, and strengthened by radially extending web supports 72.

Figure 4:
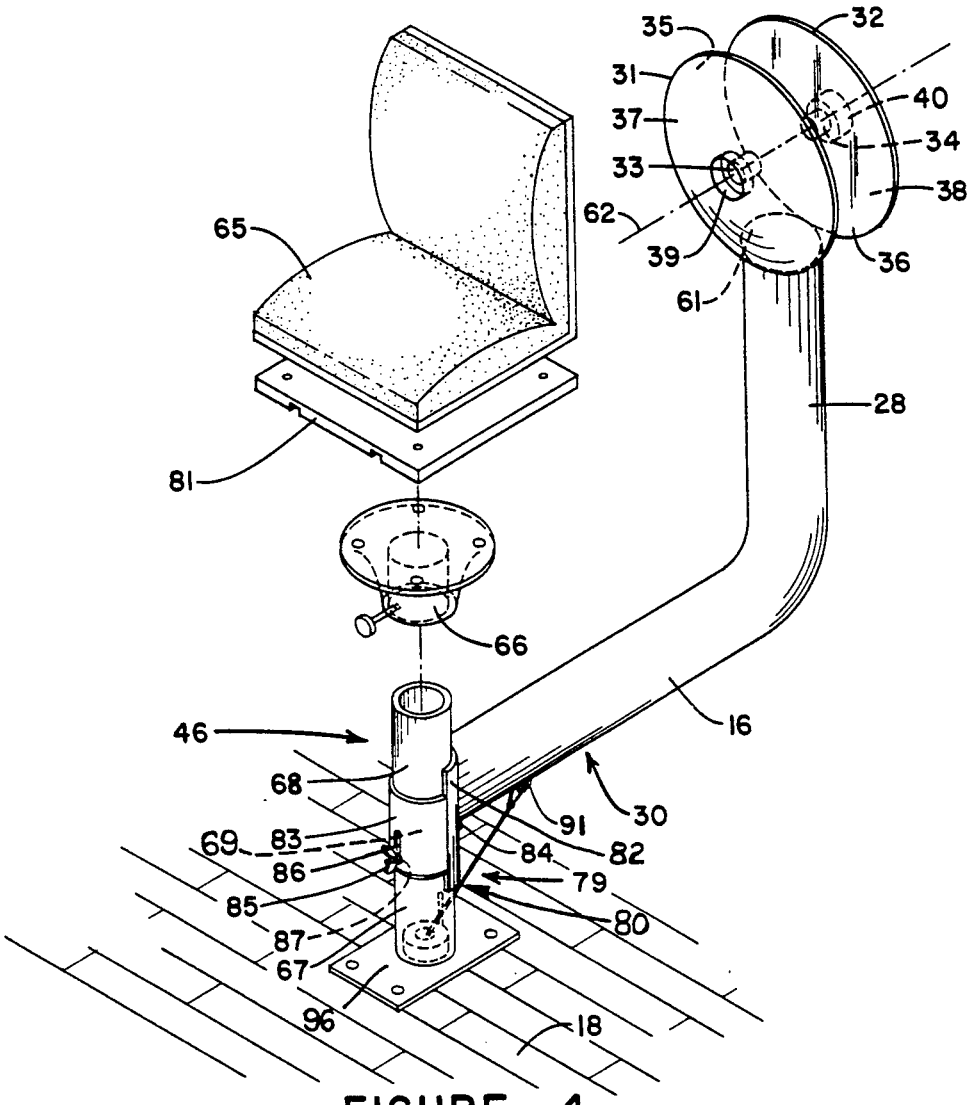
FIG. 4 is an isometric view of the second support arm showing a portion of the roll guard means, chair mounting means, position locking means, and stopping means.

Second support arm 16, shown in FIG. 4, is also a casted beam consisting of an upper portion 28 in pivotal communication with roll cylinder 29, and a lower portion 30 angled 90 degrees in a vertical plane relative to upper portion 28 such that, when the apparatus 1 is assembled as shown in FIG. 1, lower portion 30 is parallel to front portion 19 of first support arm 15, and pointing toward the vertical plane formed by vertical support column 4 and pitch axis 60.

Upper portion 28 of second support arm 16 includes first roll plate 31 and second roll plate 32 attached to second support arm 16 by either welding or cast as a part of second support arm 16. Both first and second roll plates 31, 32 have holes 33, 34 formed in their respective centers perpendicular to their respective inner walls 35, 36, and are attached to the top 61 of upper portion 28 of second support arm 16 so that the centers of holes 33, 34 are aligned to form a roll axis 62 perpendicular to inner walls 35, 36. Outer walls 37, 38 of roll plates 31, 32 are each shaped to form an outwardly convex surface. Recesses 39, 40 are formed concentric with holes 33, 34 into outer walls 37, 38 to a depth sufficient to accommodate fastening hardware to avoid hardware contact with persons aboard the craft.

Also shown in FIGS. 1 and 4 is chair mounting means 46, which may consist of simply a cylindrical post 68 attached perpendicularly to lower portion 30 either by welding or cast as a part of lower portion 30. In a preferred embodiment, cylindrical post 68 is a section of standard size $2\frac{7}{8}$ inch outer diameter aluminum tubing. This arrangement allows for use of the invention with a seat 65 of the operator's own choosing by virtue of cylindrical post 68 being capable of insertion into a standard seat bracket 66 common in the watercraft industry. By the addition of adjustable seat accessories known in the art, the operator is free to provide himself with as much adjustability as he desires while still enjoying the full stabilizing response features of the invention. In the event that the operator wishes not to use apparatus 1 as a stabilizing device, a position locking means 79 is provided which prevents response to both pitch and roll motions. In a preferred embodiment, position locking means 79 consists of a clamp means 80 attached in part to the lower end 69 of cylindrical post 68 for locking communication with a pedestal 67 removably attached to deck 18 by insertion over pedestal base 98. Pedestal base 98 may be welded to plate 96, which in turn may be attached to deck 18 in any manner common in the art, such as by bolting. Clamp means 80 may consist of a first section of half-circular shaped tubing 82 permanently attached by welding to lower end 69 and extending below lower end 69. A second section of half-circular shaped tubing 83 is located opposite first tubing section 82 and is slidable relative to lower end 69. Second tubing section 83 contains vertical slot 86 and is secured to lower end 69 by way of bolt 84 through hole 87 formed through the diameter of lower end 69 and by wing nut 85. In this configuration, the meeting ends of lower end 69 and pedestal 67 are precisely matched to ensure no vertical motion of the apparatus 1 due to flexion of any supporting members. Both lower end 69 of post 68 and pedestal 67 may consist of standard aluminum tubing of $2\frac{7}{8}$ inch outer diameter.

Figure 7:
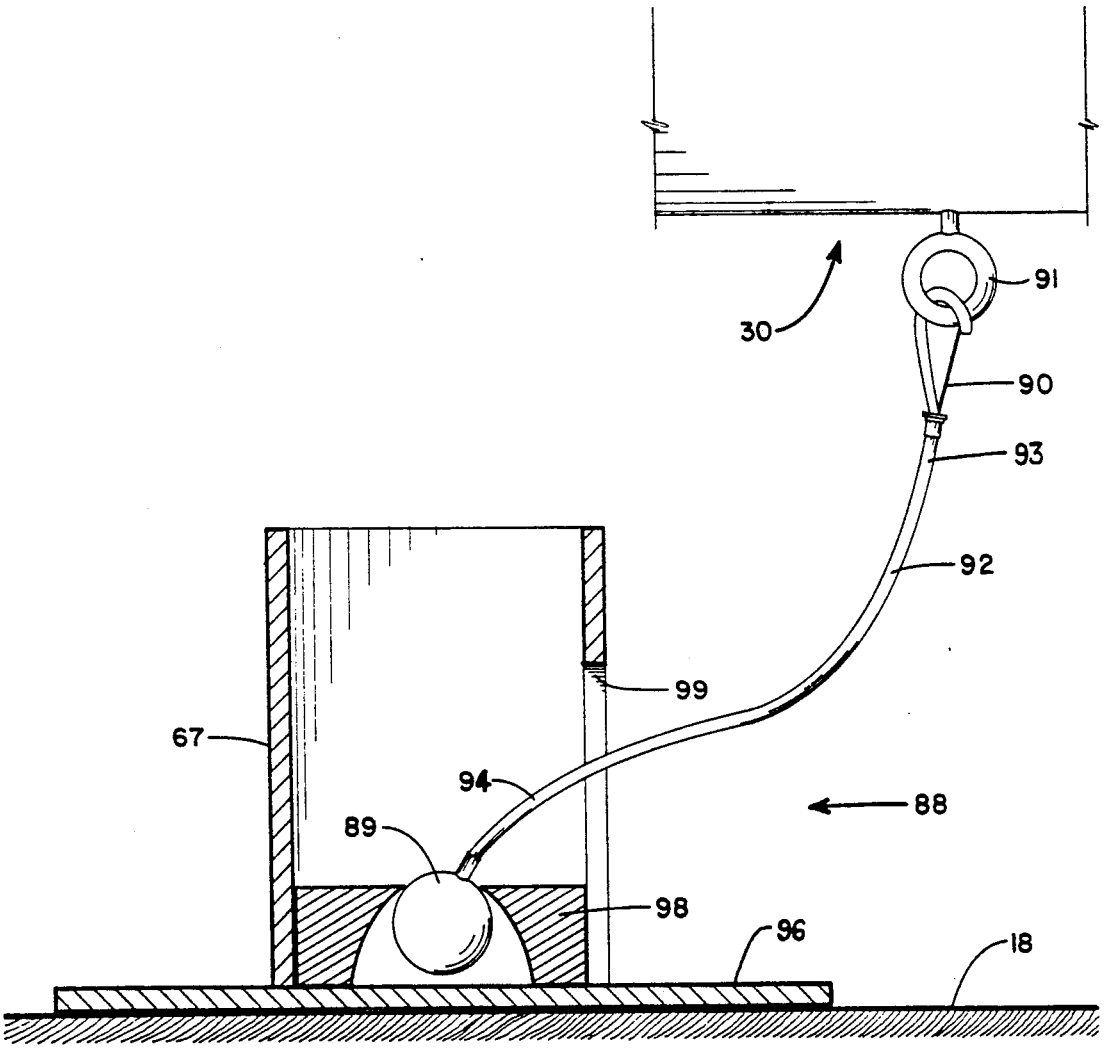
FIG. 7 is an elevation view of a portion of position locking means and also of stopping means.

Also provided in a preferred embodiment as a safety measure is a stopping means 88, shown in FIGS. 1, 4, and 7, which prevents damage to bearing assemblies 48, 49 while apparatus 1 is in use by stopping the motion of either first support arm 15 or second support arm 16 before they reach their physical limits of rotation when responding to pitch and roll motions. Stopping means 88 may consist of cable 92 having a first end 93 attached by the use of first eye bolt snap 90 to first eye bolt 91 fixedly attached to lower portion 30 of second support arm 16. Opposite end 94 of cable 92 includes a single-shank ball 89 crimped onto opposite end 94 to retain cable 92 within tapered hole 97 formed through pedestal base 98. Vertical slot 99 is provided in pedestal 67 so that apparatus 1 may be placed in a locked position without detaching stopping means 88.

In operation, position locking means 79 is disengaged by moving second tubing section 83 upward and tightening it in place with wing nut 85. Pedestal 67 is then removed from pedestal base 98. As either first support arm 15 or second support arm 16 is caused to approach their limit of motion, stopping means 88 is extended until its maximum length is reached and further motion in that direction is halted, thus preventing jarring contact which could otherwise damage bearing assemblies 48, 49. As will be understood by those with ordinary skill in the art, the dimensions of stopping means 88 must be precisely determined according to the dimensions of first and second support arms 15, 16 so that maximum response to pitch and roll motions is maintained.

As can be inferred from FIGS. 2, 3 and 4, the extent to which first support arm 15 is allowed to rotate in response to pitch motion with respect to support column 4 is a function of the perpendicular distance between the top 59 of support column 4 and pitch axis 60 passing between first and second pitch holes 7, 8, and of the cross-sectional sizes of support column 4 and first support arm 15. This combination of distance and cross-sectional size should be such that first support arm 15 is allowed to pivot as much as 45 degrees in either direction from horizontal, and also manually rotatable through an arc of 270 degrees in the event it is desired to position apparatus 1 to face in the opposite direction. Likewise, the extent to which second support arm 16 is allowed to rotate in response to roll motion with respect to first support arm 15 is a function of the perpendicular distance between the top 61 of upper portion 28 and roll axis 62 passing between first and second roll holes 33, 34, and of the cross-sectional sizes of first support arm 15 and second support arm 16. This combination of distance and cross-sectional size should be such that second support arm 16 is allowed to pivot as much as 45 degrees in either direction from vertical, and also manually rotatable through an arc of 270 degrees in the event it is desired to position apparatus 1 to face in the opposite direction.

Figure 6:
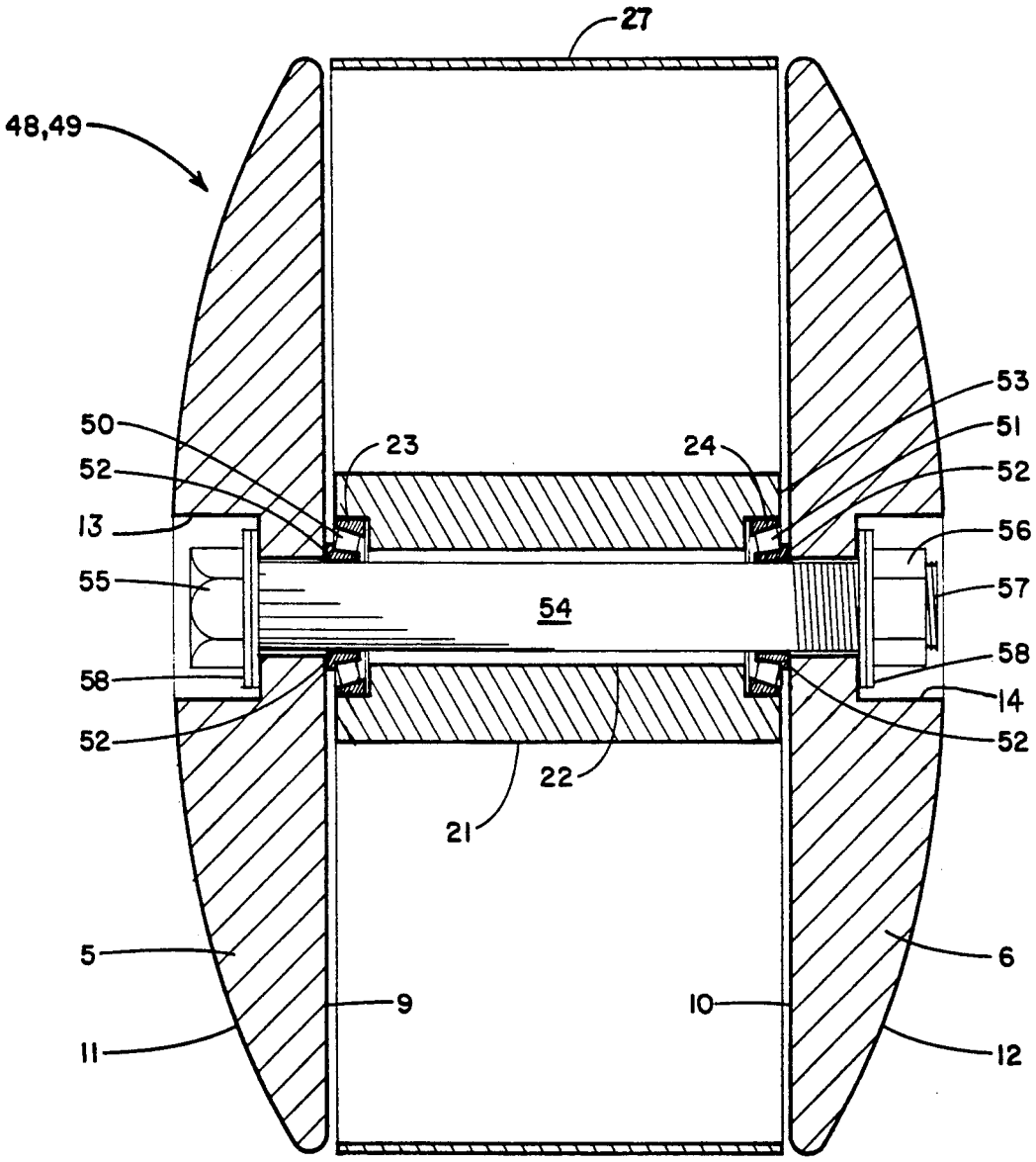
FIG. 6 is a sectional view of the bearing assemblies present in the connection between the support column and the first support arm and in the connection between the first support arm and the second support arm.

FIG. 6 is a sectional view of both the pitch bearing assembly 48 and the roll bearing assembly 49. Pitch bearing assembly 48 includes first and second bearings 50, 51 capable of supporting both radial and thrust loads and set within first and second counterbores 23, 24, respectively, such that a sufficient portion of bearing shoulder 52 extends beyond edges 53 of pitch cylinder 21 for contact with inner wall 9, 10 of pitch plates 5, 6, respectively, to allow free rotation of pitch bearing assembly 48. Pitch shaft 54 is rotatable within pitch shaft hole 22 and may consist of a partially threaded pitch bolt 55 securing first support arm 15 to support column 4 by the use of a nut 56 threaded onto bolt end 57 of bolt 55 with any necessary washers 58 in a manner common to those with ordinary skill in the art. The assembled combination of bolt 55, nut 56, and washers 58 should be of a length not to extend beyond outer walls 11, 12 of first and second pitch plates 5, 6, respectively, and so as to be fully contained within recesses 13 14. An identical arrangement may be used in roll bearing assembly 49.

Figure 5:
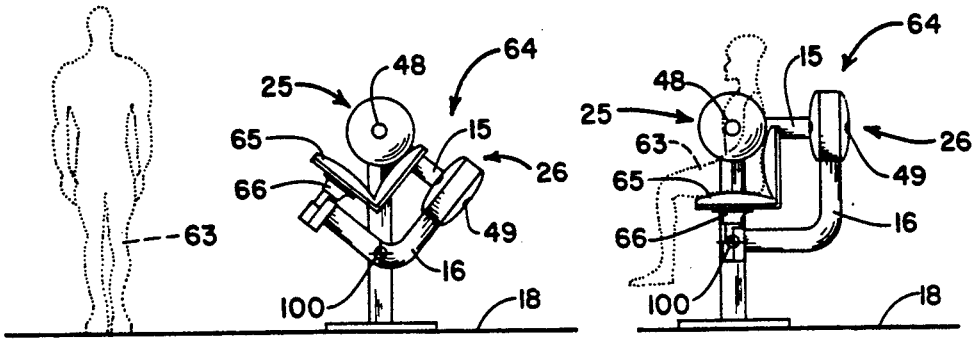
FIG. 5 is a side view of the invention before and after being occupied by an operator illustrating the changing position of the main assembly.

For installation in the craft, the apparatus 1 is bolted to deck 18 at its base 3 in a position that will afford the operator optimum access to necessary controls and provisions, taking into consideration the magnitude of roll and pitch motions expected in the craft. As shown in FIG. 5, when apparatus 1 is not in use, the main assembly 64 consisting of first support arm 15 and second support arm 16 will not be level, but will tilt forward due to the center of gravity 100 of main assembly 64 having to remain directly under pitch bearing assembly 48. When seat 65 is installed, main assembly 64 will become more level as weight is added to balance the weight of main assembly 64. When operator 63 sits in seat 65, main assembly 64 will move further back until operator 63 is in a substantially level position. In order for operator 63 to be level, the combined center of gravity 100 of operator 63 and main assembly 64 must be directly under pitch bearing assembly 48. The degree to which a particular operator 63 will be level while the craft is stationary is determined by the actual dimensions and density of material used for first support arm 15 and second support arm 16, as well as how operator 63 chooses to sit in seat 65. Likewise, modified designs of apparatus 1 may include shortened or lengthened versions of either or both of first support arm 15 and second support arm 16. Such changes will affect the stabilizing response of apparatus 1 when the craft is in motion, and will thus affect the comfort of operator 63. Because of the response sensitivity of apparatus 1 and the diversity of operators that may use it, it is preferred that a seat bracket 66 of horizontally rotative adjustability be used which features a slidable rack 81 for adjusting the combined center of gravity of operator 63, seat 65 and main assembly 64 for optimum level control. In such a configuration, an operator 63 of virtually any size may enjoy level stabilization and may do so facing in any direction. Moreover, the apparatus 1 may be manipulated to face in an opposite direction simply by rotating each of first and second support arms 15, 16, through 180 degrees.

By way of specific example, the inventors have empirically discovered that when all other dimensions of apparatus 1 are fixed, upper portion 28 of second support arm 16 provides optimum response to roll motion when the length of upper portion 28 is between 11.5 inches and 14.0 inches, preferably at about 12.5 inches depend on the size of seat bracket 66. Distances less than 11.5 result in instability, and distances greater than 14.0 inches do not provide enough responsiveness to maximize comfort of operator 63. Similar experiments have been conducted by the inventors to determine size ranges for various other parts of the invention keeping in mind the desire to minimize the size of apparatus 1, but in light of the infinite variety of possible users and their personal preferences, such determinations are highly variable and subjective. However, it will be understood that any and all such variations of this nature still remain within the scope of the claims provided herein.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

We claim:

1. An apparatus for stabilizing a seat used in a boat comprising:

a) a support means having a base fixedly attachable to a boat for supporting said apparatus, said support means having a top;

b) a first support arm having a front portion and a back portion, said front portion being pivotally attached to said support means in a manner to remain about horizontal when in use, and said back portion being angled 90 degrees in a horizontal plane from said front portion;

c) a second support arm having an upper portion and a lower portion, said upper portion having a top and being pivotally attached to said back portion of said first support arm in a manner to remain about vertical when in use, said lower portion being angled 90 degrees in a vertical plane from said upper portion, and said lower portion further comprising a chair mounting means to which said seat is attachable;

d) a pitch guard means operatively connected to said first support arm and said support means to substantially prevent foreign objects from entering the area of attachment between said first support arm and said support means; and e) a roll guard means operatively connected to said second support arm and said first support arm to substantially prevent foreign objects from entering the area of attachment between said second support arm and said first support arm.

2. An apparatus according to claim 1, wherein said base of said support means comprises a plate having holes through which bolts may be inserted to secure said support means to said boat.

3. An apparatus according to claim 2, wherein said support means includes a vertical column perpendicularly and fixedly attached to said base, said base comprising a horizontal plate secured by said bolts to the deck of said boat.

4. An apparatus according to claim 1, wherein said pitch guard means comprises:

i) a first plate having an upper end and a lower end, attached at said lower end to said top of said support means in a plane perpendicular to a deck of said boat, said first plate further including a hole formed perpendicular to said plane and through the center of said first plate;

ii) a second plate having an upper end and a lower end, attached at said lower end to said top of said support means in a plane perpendicular to said deck of said boat and parallel to said first plate, said second plate further including a hole formed perpendicular to said plane and through the center of said second plate; and iii) a guard cover surrounding the point of pivotal attachment between said support means and said first support arm, said guard cover having a cylindrical outer surface attached to said front portion of said first support arm.

5. An apparatus according to claim 1, wherein said roll guard means includes:

i) a first plate having an upper end and a lower end, attached at said lower end to said top of said upper portion of said second support arm in a plane perpendicular to a deck of said boat, said first plate further including a hole formed perpendicular to said plane and through the center of said first plate;

ii) a second plate having an upper end and a lower end, attached at said lower end to said top of said upper portion of said second support arm in a plane perpendicular to said deck of said boat and parallel to said first plate, said second plate further including a hole formed perpendicular to said plane and through the center of said second plate; and iii) a guard cover surrounding the point of pivotal attachment between said first support arm and said second support arm, said guard cover having a cylindrical outer surface attached to said back portion of said first support arm.

6. An apparatus according to claim 1, wherein said chair mounting means includes a cylinder fixedly attached to said lower portion of said second support arm perpendicularly to said lower portion, and to which said seat is attachable.

7. An apparatus according to claim 6, wherein said cylinder is a section of standard size aluminum tubing.

8. An apparatus according to claim 1, wherein said lower portion of said second support arm further comprises a position locking means attached to said lower portion for locking said apparatus in a fixed position and preventing a stabilizing response to both pitch and roll motions.

9. An apparatus according to claim 8, wherein said position locking means is a cylinder extending vertically downward and fixedly attached to said lower portion of said second support arm, and comprising a clamp means attached to said cylinder for making locking engagement with a fixed pedestal present in said deck.

10. An apparatus according to claim 9, wherein said downwardly extending cylinder and said fixed pedestal are sections of standard size aluminum tubing.

11. An apparatus according to claim 1, wherein said first support arm is pivotally attached to said support means to allow rotation of said first support arm through an arc of 270 degrees about said support means and to allow rotation of said first support arm of up to 45 degrees in either direction from horizontal.

12. An apparatus according to claim 1, wherein said second support arm is pivotally attached to said first support arm to allow rotation of said second support arm through an arc of 270 degrees about said first support arm and to allow rotation of said second support arm of up to 45 degrees in either direction from vertical.

13. An apparatus according to claim 1, further comprising a stopping means operatively attached at one end to said deck and at an opposite end to said lower portion of said second support arm for allowing a stopping force to prevent damage to said pivotal attachments as said first and second support arms approach their maximum respective limits of motion.

14. An apparatus according to claim 13, wherein said stopping means includes:

i) a first eye bolt fixedly attached to said lower portion of said second support arm;

ii) a cable attachable at one end to said first eye bolt;

iii) a pedestal base permanently attached to said deck, having a hole through which said cable may pass; and iv) a single-shank ball operatively attached to the opposite end of said cable, said ball being restrained under said pedestal base.

* * * * *